US008755683B2

(12) United States Patent
Biesse

(10) Patent No.: US 8,755,683 B2
(45) Date of Patent: Jun. 17, 2014

(54) FLOAT FOR INSPECTING SEWER SYSTEMS

(76) Inventor: Philippe Biesse, Bellegarde (FR)

( * ) Notice: Subject to any disclaimer, the term of this patent is extended or adjusted under 35 U.S.C. 154(b) by 3 days.

(21) Appl. No.: 13/376,176

(22) PCT Filed: May 27, 2010

(86) PCT No.: PCT/FR2010/000395

§ 371 (c)(1),
(2), (4) Date: Feb. 21, 2012

(87) PCT Pub. No.: WO2010/139865

PCT Pub. Date: Dec. 9, 2010

(65) Prior Publication Data

US 2012/0222993 A1 Sep. 6, 2012

(30) Foreign Application Priority Data

Jun. 3, 2009 (FR) ..... 09 02662

(51) Int. Cl.
*G03B 17/08* (2006.01)

(52) U.S. Cl.
USPC ..... 396/25; 396/28; 348/81; 348/82

(58) Field of Classification Search
USPC ..... 396/19, 25, 28; 348/81, 82, 84, 83, 85
See application file for complete search history.

(56) References Cited

U.S. PATENT DOCUMENTS

| | | | | |
|---|---|---|---|---|
| 3,827,068 | A * | 7/1974 | Hill et al. | 396/19 |
| 7,993,469 | B1 * | 8/2011 | Vallapuzha et al. | 134/22.11 |
| 2008/0016952 | A1 * | 1/2008 | Kiest, Jr. | 73/40.5 R |
| 2008/0210024 | A1 * | 9/2008 | Merlo | 73/865.8 |
| 2010/0033562 | A1 * | 2/2010 | Allds | 348/82 |

FOREIGN PATENT DOCUMENTS

| | | | |
|---|---|---|---|
| DE | 41 14 601 | A1 | 4/1992 |
| DE | 42 08 863 | A1 | 9/1993 |
| DE | 93 20 538 | U1 | 9/1994 |
| DE | 299 00 544 | U1 | 4/1999 |
| DE | 69700544 | | 5/2000 |
| DE | 202006016642 | U1 | 6/2007 |
| EP | 1749944 | A2 | 2/2007 |

* cited by examiner

*Primary Examiner* — Clayton E Laballe
*Assistant Examiner* — Warren K Fenwick

(57) ABSTRACT

The device used for collecting information on the condition of a sewer network.

It includes a set of observation devices mounted on a floating housing (1) introduced in the sewer pipe flow and connected by the rear (8) to a check cable which the operator can unreel from the surface of an upstream manhole, and is completed by display, control and optional recording systems on the surface.

The on-board devices comprise a pan and tilt surface camera housed behind a glass dome (2), a bottom camera (3), distance detectors (6 and 7), a system transmitting wireless signals (5), lights, and batteries (4). The signals run along the inside of the pipe to a receiver located at a manhole and from there are transmitted to the station on the surface.

The components are compact, reliable and preferably derived from mass-produced devices such as video surveillance cameras, computers or video screens.

30 Claims, 2 Drawing Sheets

FLOAT FOR INSPECTING SEWER SYSTEMS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION BY REFERENCE OF MATERIAL SUBMITTED ON A COMPACT DISC

Not Applicable

BACKGROUND OF THE INVENTION

1. Technical Field

This invention refers to a device that helps a sewage network manager collect information about the condition of the network in order to maintain it in good operating condition.

A network needs to be cleaned periodically to get rid of deposits and other obstructing materials and to guarantee optimal flow of the water through its pipes.

The cleaning process needs to be done every 6 month to 12 years with an average periodicity of 3 years depending on the characteristics of the network.

The purpose of network monitoring is to adjust the cleaning frequency and to check the pipes for structural condition or other problems.

2. Background Art

Traditionally, man holes and pipes of big dimensions are observed directly by visiting them. For smaller pipes, the inspection can be made from the top of a visiting chamber with the help of a wired camera fitted at the lower extremity of a vertical pole put in the chamber down to the pipe inlet, and that can observe the inside of the pipe on a limited length.

This kind of inspection is more or less complete, and more or less difficult to implement whether it is realized directly without preparing the pipe or after draining and cleaning it.

Another usual method is to insert a wired camera mounted on a remote control wheeled cart that moves inside the pipe after the latter has been drained and cleaned.

The drawbacks of these methods are that they involve, depending on the situation:

- The presence of a person inside a confined environment with hygiene risk and exposure to dangerous gas like H2S,
- The continuous presence of a complete team including someone able to interpret the observation, such a team being generally mobilized during day time when the sewage flow is maximum.
- A low ratio of distance of piping observed over time spent and means deployed.
- A necessity to cut or limit the water flow in the pipe which then cannot accomplish its primary function during the observation or that has to be by-passed by an alternate system to be installed,

- A relatively regular bottom surface of the pipe without big obstacles or differences in level for the cart to be able to progress smoothly,
- Expensive equipment that are limited in number and cannot be used in situations where there is a risk of damage or loss.
- The opening of many chambers for access, display and ventilation and thus causing odours, safety and circulation problems for the neighbourhood,
- Limited distance between visiting chambers to allow observation of the whole piping section.

The following patents are related to the art.

Patent DE 4114601 describes a wheeled inspection unit moved along inside the sewage pipes and connected to a control and evaluation unit at least partially without.

Patent DE 4208863 describes an arrangement which has a transport mechanism with a signal generator and receiver. The signal generator is in the form of a microwave generator which produces synthetic pulses.

Patent EP 1749944 describes an inspection device which has compressed air supply for cleaning of water when positioning the pressure-tight housing at the channel wall. A waterproof camera unit is provided for taking pictures of the channel wall in the housing.

Patent DE29900544 which describes a device that transmits visual information of a sewer pipe to a display unit at the surface. The device consists of a housing in which a camera and lights linked by wire to a display unit at the surface and a nozzle used to push the device inside the pipe.

Patent DE9320538 describes a wheeled housing in which a camera, a location sensor and a storage unit are fitted, used to record visual and location information in a pipe and to deliver them afterwards to a processing and visualization unit at the surface.

Patent DE20 2006 016 642 describes a floating housing on which is fitted a camera and a lighting system and is held on one side by an electrical wire (to transmit signals and to exert a pulling or retaining action) and pulled on the other side by cleaning nozzles normally used for cleaning sewer piping.

BRIEF SUMMARY OF THE INVENTION

The invention allows remedying these drawbacks while ensuring an easy and economical way of estimating if cleaning is required and where the deposits are located, helping in the performance of the periodical inspection of networks and in the follow up of the evolution of some known disorders or the evolution of the structure after repairing work.

It consists in using a set of observation equipment mounted on a floating housing linked at its rear to a check cable that the operator located at the surface of the upstream visiting chamber can control.

The observation equipment is fed electrically by the inboard direct current battery and emit signals via electromagnetic waves that are relayed by one (or several) antenna along the inside of the pipe up to the antenna of a receiver located in the upstream or alternately in the downstream visiting chamber, and are finally transmitted wireless or by cable up to the observation and recording unit located on the surface.

The selected equipment is lightweight, reliable, and preferably derived from widely commercialized series of equipment in order to be cheap.

Figure 1:
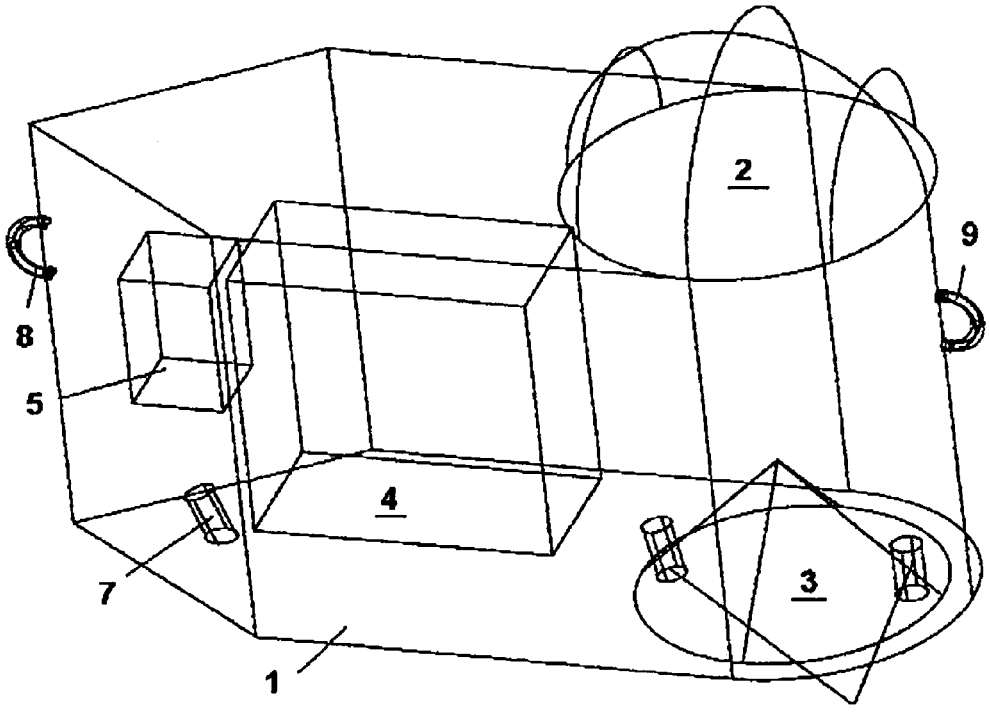
FIG. 1 represents a transparent perspective view of the float for inspecting sewer systems with main equipment. The configuration and equipment represented are not limited within the framework of the invention, the dimensions and the shapes are simplified for visual clarity.

Floating housing 1 and it main equipment, the glass dome housing the surface camera 2, the window at the bottom of the floating housing under the floatation line housing the bottom camera 3, the battery 4, the electronic signal transmitting block 5, the light beam distance detectors 6, another rear distance detector 7, the rear hook 8 for check cable, the front hook 9 for traction cable.

Figure 2:
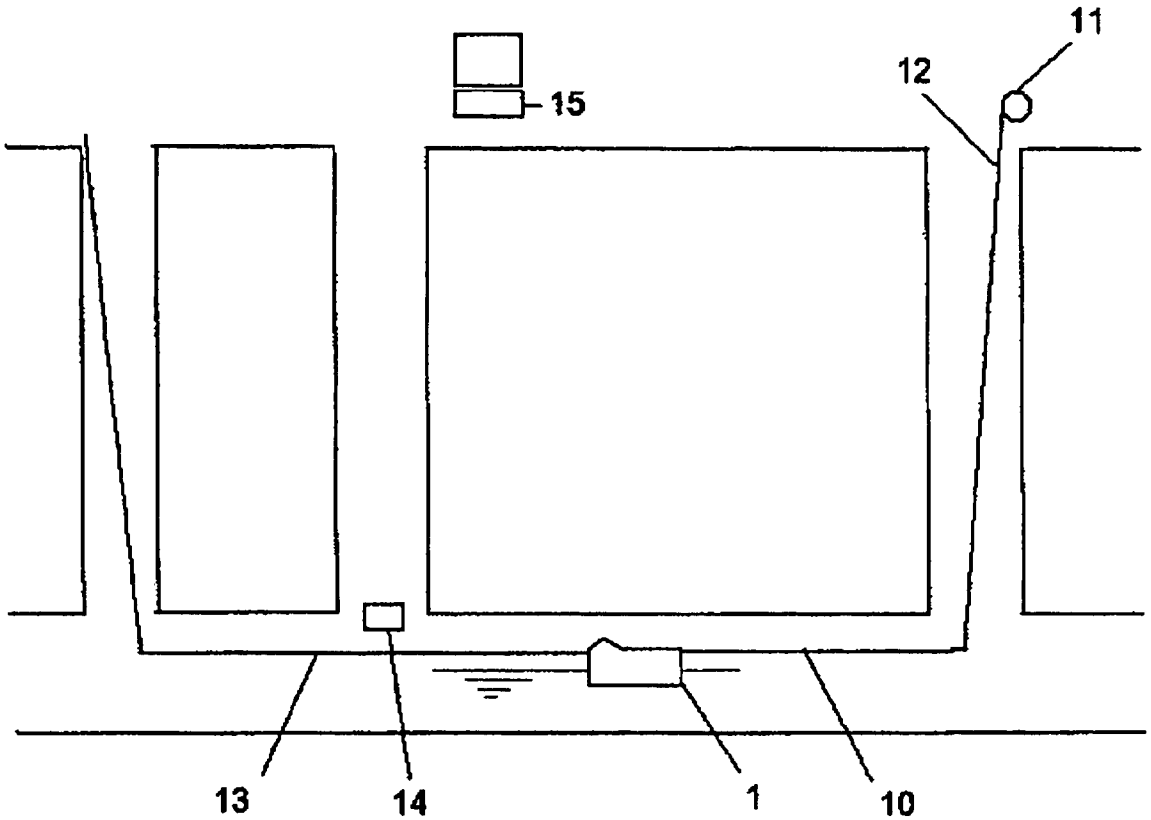

FIG. 2 represents a schematic view of the float for inspecting sewer systems in an inspection configuration in a sewer section.

The floating housing 1 attached at its front end to the traction cable 13 and at its rear to the check cable 10, itself linked to the extension pole 12 and reeled on the bobbin 11, relaying unit 14 transmits the signals to the observation unit 15.

DETAILED DESCRIPTION OF THE INVENTION

According to a first characteristic, the device includes a floating housing 1 made up of a middle lower compartment which houses the batteries 4, of a front lower compartment with a camera 3 behind a transparent, water tight and shock resistant port hole located under the waterline and facing down, of a top front water tight transparent glass dome housing a camera 2, preferably swivelling or pan and tilt type, of a rear compartment containing the electronics for signal transmission and antennas 5 and optional windows which can house distance measurement systems 6 and 7.

The outer surface of the housing 1 guarantees water tight junction to the various windows, and a water tight removable cap closes over the upper middle part so that the different components can be fit or removed. The water tightness will be the best possible to avoid water penetration as well as gas penetration in order to prevent the effects of oxidation from HS2. This waterproofing can be improved by applying flexible covering on the joints after assembly of the equipment in the housing 1 and by using tropicalized electronics or desiccant bags. The charge of the battery 4 is made without opening the housing I via an outside socket.

The shape and volume of the housing I and the location of heavy elements under the waterline insures its floatability and pitch, roll and yaw stability in spite of the turbulent water flow in the pipes.

The glass pane of the front lower porthole is in direct contact with the water which facilitates the visualization through the liquid. The upper glass dome is made of anti-shock material and is preferably protected by metal stems. The housing 1 material can be metallic, plastic, glass-fibre reinforced resin or any other adequate material. p The glass pane of the front lower porthole is in direct contact with the water which facilitates the visualization through the liquid. The upper glass dome is made of anti-shock material and is preferably protected by metal stems. The housing 1 material can be metallic, plastic, glassfibre reinforced resin or any other adequate material.

According to a second characteristic, the device includes a thin check cable 10 that allows the operator to control the progression of the floating housing 1 on the water flow.

The cable is long enough to allow the displacement of the housing over the distance of one or several intervals between visiting chambers, and is thin enough to make up a light, trim bobbin 11 when rolled up. It is composed of braided fibres, or nylon single strand like in a fishing rod, or multi-strands steel cable or other kinds of cable material to be determined in relation to the distance between visiting chambers, the strength required, and the minimizing of the drag in the water flow and of the risks of getting stuck or jammed.

There are advantages in using a light cable that floats on the water surface rather than a cable that drags on the bottom deposits, or a single strand cable that does absorb water and is easier to drain and clean.

The bobbin 11 can be reeled manually or mechanically like a fishing rod reel.

The lowering of the cable to the bottom of the visiting chamber can be achieved by simply unrolling it down or by having it guided by an extension pole l2.

The complete bobbin set can take the shape of a telescopic fishing rod, reel and nylon cable. To optimize the observation, the operator will choose the period of day with most favorable water level, speed, stability of flow, and clarity of water in the pipe. These conditions may not be sufficient to insure the forward move of the floating housing in the pipe. It is possible to create this forward movement through traction on another cable 13 placed at the front of the housing. This other traction cable 13 being previously introduced in the pipe with a floating object tied at its extremity when the water flow was strong enough to draw the set to the next visiting chamber.

It would be possible to motorize the housing like a boat or a remote controlled miniature submarine, however the cable is a guarantee that one can pull the float back to the visiting chamber when damage or loss of contact of any system would not.

According to a third characteristic, the device includes a surface camera 2, preferably of swivelling, pan and tilt type. It can also be without swivelling capability depending on pipe diameter and picture angle of its lens, or can be replaced by several fix cameras, but the aim is to be able to view as exhaustively as possible the inside surface of the pipe from a position of the device that can only be controlled in its longitudinal position. The camera will preferably be equipped with autofocus system.

The camera pointing angle will be in a relation to the two directions upper/lower and right,/left and the movements will stay within the inside of the glass dome. This arrangement guaranties the water tightness of the system and may be realized with parts resembling surveillance cameras and anti-vandal glass domes.

According to a fourth characteristic, the device includes a fix, or even swivelling camera at the bottom 3. The camera is protected by a flat port hole. Depending on its distance to the bottom of the pipe and the water clarity, this camera shows the lower immersed part of the pipe,. Observation is possible up to the agitated and turbid zone located between the flowing liquid zone and the pipe. The camera can also visualize the projection of the light beams 6 to the bottom surface as used in sixth characteristic for measuring the distance.

According to a fifth characteristic, the device in includes a lighting system that can be built in with the cameras with night vision or can be independent with white or infra red spotlights. Preacuations will be taken to avoid light reflection on the inside surface of the glass dome.

According to a sixth characteristic, the device includes one or several probes 6 and 7 to measure the distance of the pipe walls or of the deposits in relation to the housing. The measurements are in the vertical or horizontal axis.

The systems can be ultra sonic (radar), hydrostatic or optical. An example consists in using two concentrated light beams 6 such as mini red "laser" beams located in the same vertical plane, each on one side of the housing and oriented with relative angle towards the surface to be observed. The distance of the two impacts on the surface as seen by the camera is in proportion to the distance of the housing to the observed surface.

Another example is to equip the float with a hydrostatic probe used to determine the distance to the pipe bottom. It can be made for example of a weighted bulb filled with liquid of a different density than water and connected to the housing by a small pipe. When the bulb drags on the bottom, the difference of density of the liquids and the variation of relative level of the bulb involve a displacement of liquid in the small pipe that is visible on the camera picture.

A piezomeric probe scraping the bottom of the pipe and sending an electrical signal can also be used.

According to a seventh characteristic, the device includes one or several signal transmission/reception systems. Although the transmission of signals via cables would be possible, the wireless systems are considered in priority.

The cameras video signals are either treated by its electronics and transmitted directly in the form of electromagnetic waves toward the receptor located at the upstream (or downstream) visit chamber or are processed by specific transmission systems.

There are plenty of cheap systems widely commercialized and used in the video surveillance market, like wired cameras, wireless cameras with associated reception systems, or wireless cameras with an IP address functioning with WI-FI technology, or in the audiovisual market like wireless audio-video transmitters, or in computer market with WI-FI technology or in high frequency remote control technology.

The antennas are preferably high gain and are arranged in an optimal manner and above water surface for the best results in signal transmission.

The transmission/reception system links the equipment 5 on board of the housing 1 with the corresponding unit 14 put in the upstream (or downstream) visiting chamber, and the latter relays the signals via wire or wireless technology to an observation and possibly recording unit 15 located on the surface of the same chamber.

In the case of a swiveling camera, the relaying unit 14 also transmits the signals from the observation unit 15 to the on board equipment.

According to an eighth characteristic, the device includes an observation and recording unit 15 that treats the signals sent by the relaying unit 14 situated in the nearest chamber.

In addition to its electronics, the observation unit includes a video display and can also include a video recording unit.

TV sets and video recorder can be used, as well as a computer equipped with adequate video jacks or WI-FI connection cards. The computer ensures observation, recording and image processing functions, and can also process directly other types of signals and transcribe the measurements directly into a pipe profile.

BEST MODE FOR CARRYING OUT THE INVENTION

A standard way of realizing the invention is basically with wireless pan and tilt video surveillance cameras. A router can be used as a relay system at the level of the nearest chamber, and the suitably equipped computer will be used for visualization and recording purposes This configuration is adapted for use by a technician, while a more rustic version using wireless video surveillance equipment linked to a surveillance screen and a video recording system will be used by a less qualified operator.

In both cases, when an obvious defect zone is observed during operation, the operator can control the device and scan more accurately the zone.

Industrial Applicability.

Numerous applications exist for the numerous sewage networks managers.

What I claim is:

1. Mobile floating apparatus for inspecting sewer systems, introduced on a sewer water surface and used for collecting information on the condition of a sewer network characterized in that it consists in:

a water tight floating housing including a set of observation and signal transmission/reception pieces of equipment, said pieces of equipment being battery operated, said floating housing being held by a check cable linked to a hook located at its rear, said check cable being controlled by an operator located at the surface of an upstream manhole in which a unit relaying the signals has been introduced, said relaying unit being in turn connected to a control and display unit located at the surface near the manhole, the signals transmission between said signal transmission/reception pieces of equipment mounted on said floating housing and said relaying unit being of wireless type.

2. Apparatus of claim 1 characterized in that the system is completed by a visual signal recording system.

3. Apparatus of claim 1 characterized in that one of said observation equipment is a surface camera housed in a glass dome located at the front part of said floating housing.

4. Apparatus of claim 1 characterized in that said front camera is of pan and tilt type.

5. Apparatus of claim 1 characterized in that another piece of said observation equipment is a bottom camera housed behind a port view at the front of said floating housing, under the floatation line.

6. Apparatus of claim 1 characterized in that another piece of said observation equipment are concentrated light beams, whose trace on the pipe walls give a measurement of the distance from the float.

7. Apparatus of claim 1 characterized in that said signals transmitted by said transmission/reception pieces of equipment use wireless support widely used for video surveillance applications.

8. Apparatus of claim 1 characterized in that said display unit is a dedicated standard video screen.

9. Apparatus of claim 1 characterized in that said recording and display units are a computer equipped with wireless transmission cards and recording capacity.

10. Apparatus of claim 1 characterized in that adequate lamps improve the visibility of the observation equipment.

11. Apparatus of claim 1 characterized in that the system can accommodate for a plurality of relaying unit between said floating housing and said control and display unit.

12. Apparatus of claim 1 characterized in that a traction cable is attached to a hook located at the front end of said floating housing and is pulled by an operator located at a downstream manhole to force said floating housing front move.

13. Apparatus of claim 1 characterized in that said cheek cable and said traction cable are controlled by the operator with a pole and bobbin resembling a fishing pole arrangement.

14. Apparatus of claim 1 characterized in that one of said under floatation line observation piece of equipment consists in a ultrasonic probe.

15. Apparatus of claim 1 characterized in that one of said under floatation line observation piece of equipment consists in a hydrostatic probe hanging from the bottom of the floating housing.

16. Mobile floating apparatus for inspecting sewer systems, introduced on a sewer water surface and used for collecting information on the condition of a sewer network characterized in that it consists in:

a water tight floating housing including a set of observation and signal transmission/reception pieces of equipment, said pieces of equipment being battery operated, some of said observation pieces of equipment being located above floatation line as other ones being located under the floatation line, said floating housing being held by a check cable linked to a hook located at its rear, said check cable being controlled by an operator located at the surface of an upstream manhole in which a unit relaying the signals has been introduced, said relaying unit being in turn connected to a control and display unit located at the surface near the manhole, the signals transmission between said signal transmission/reception pieces of equipment mounted on said floating housing and said relaying unit being of wireless type.

17. Apparatus of claim 16 characterized in that the system can accommodate for a plurality of relaying unit between said floating housing and said control and display unit.

18. Apparatus of claim 16 characterized in that a traction cable is attached to a hook located at the front end of said floating housing and is pulled by an operator located at a downstream manhole to force said floating housing front move.

19. Apparatus of claim 16 characterized in that said cheek cable and said traction cable are controlled by the operator with a pole and bobbin resembling a fishing pole arrangement.

20. Apparatus of claim 16 characterized in that one of said under floatation line observation piece of equipment consists in a ultrasonic probe.

21. Apparatus of claim 16 characterized in that one of said under floatation line observation piece of equipment consists in a hydrostatic probe hanging from the bottom of the floating housing.

22. Apparatus of claim 16 characterized in that the system is completed by a visual signal recording system.

23. Apparatus of claim 16 characterized in that one of said observation equipment is a surface camera housed in a glass dome located at the front part of said floating housing.

24. Apparatus of claim 16 characterized in that said front camera is of pan and tilt type.

25. Apparatus of claim 16 characterized in that another piece of said observation equipment is a bottom camera housed behind a port view at the front of said floating housing, under the floatation line.

26. Apparatus of claim 16 characterized in that another piece of said observation equipment are concentrated light beams, whose trace on the pipe walls give a measurement of the distance from the float.

27. Apparatus of claim 16 characterized in that said signals transmitted by said transmission/reception pieces of equipment use wireless support widely used for video surveillance applications.

28. Apparatus of claim 16 characterized in that said display unit is a dedicated standard video screen.

29. Apparatus of claim 16 characterized in that said recording and display units are a computer equipped with wireless transmission cards and recording capacity.

30. Apparatus of claim 16 characterized in that adequate lamps improve the visibility of the observation equipment.

* * * * *